US006902373B1

(12) United States Patent
Glanton

(10) Patent No.: US 6,902,373 B1
(45) **Date of Patent: *Jun. 7, 2005**

(54) SHEET METAL EXHAUST ADAPTER FOR DRAFT INDUCERS

(75) Inventor: Byron D. Glanton, Bentonville, AR (US)

(73) Assignee: Fasco Industries, Inc., Cassville, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/255,234

(22) Filed: Sep. 26, 2002

(51) Int. Cl.[7] ..... F04D 29/44

(52) U.S. Cl. ..... 415/207; 415/212.1; 415/213.1; 415/214.1

(58) Field of Search ..... 415/203, 206, 415/212.1, 182.1, 204, 207, 211.2, 214.1, 213.1

(56) References Cited

U.S. PATENT DOCUMENTS

| | | | | |
|---|---|---|---|---|
| 87,625 A | | 3/1869 | Bookwaller | 415/182.1 |
| 877,191 A | * | 1/1908 | Hanson | 415/204 |
| 4,247,250 A | | 1/1981 | Lipe et al. | 415/215.1 |
| D263,839 S | | 4/1982 | Somme | |
| 5,040,943 A | | 8/1991 | Dwyer et al. | 415/26 |
| 5,112,190 A | | 5/1992 | Kajiwara et al. | 415/215.1 |
| 5,133,642 A | | 7/1992 | Kajiwara | 415/215.1 |
| 5,310,310 A | | 5/1994 | Nakatsukasa et al. | 415/214.1 |
| 5,358,380 A | | 10/1994 | Arakawa | 415/200 |
| 5,414,999 A | | 5/1995 | Barnes | 60/722 |
| 5,820,458 A | | 10/1998 | Lai | 454/354 |
| 5,864,190 A | | 1/1999 | Bacchiocchi | 310/89 |
| 5,951,245 A | | 9/1999 | Sullivan | 415/192 |
| 5,997,246 A | | 12/1999 | Humbad | 415/119 |
| 6,155,781 A | | 12/2000 | Tsai | 415/206 |
| 6,206,633 B1 | | 3/2001 | Nakamura et al. | 415/151 |
| 6,314,894 B1 | | 11/2001 | Gatley, Jr. | 110/341 |
| 6,468,034 B1 | | 10/2002 | Garrison et al. | 415/212.1 |
| 2002/0025252 A1 | | 2/2002 | Gatley, Jr. | |

OTHER PUBLICATIONS

Drawing specification "Exhaust Adapter", Drawing No. 8501 4019, Fasco Industries, Inc., admitted prior art.

Drawing specification "Exhaust Adapter", Drawing No. 8637 4070, Fasco Industries, Inc., admitted prior art.

Drawing specification "Blower Assembly", Part No. 7021 10046, Fasco Industries, Inc., admitted prior art.

Drawing specification "Blower Assembly", Part No. 7002 2941, Fasco Industries, Inc., admitted prior art.

* cited by examiner

*Primary Examiner*—Edward K. Look
*Assistant Examiner*—Dwayne White
(74) *Attorney, Agent, or Firm*—Andrus, Sceales, Starke & Sawall, LLP

(57) ABSTRACT

An exhaust adapter for use with a draft inducer having a blower housing with a rectangular blower outlet. The exhaust adapter provides a transition from the rectangular outlet of the blower housing and a round exhaust pipe. The exhaust adapter includes a transition section extending between an attachment flange and a round exhaust outlet. The exhaust adapter thus facilitates attachment of the blower housing to a round exhaust pipe. The exhaust adapter is formed from two sections of stamped metal joined to each other along a top and a bottom seam. The two sections of stamped metal allow the exhaust adapter to be formed using inexpensive materials and an inexpensive manufacturing process.

4 Claims, 9 Drawing Sheets

SHEET METAL EXHAUST ADAPTER FOR DRAFT INDUCERS

BACKGROUND OF THE INVENTION

The present invention is directed to an exhaust adapter for use with a draft inducer of a high-efficiency furnace. More specifically, the present invention is a two-piece stamped metal exhaust adapter configured for attachment to the blower housing of a draft inducer such that the rectangular outlet of the blower housing can be coupled to a round exhaust pipe.

The need to heat structures to control the interior temperature has been a requirement for modern housing for a long time. One of the current popular methods to heat structures is with a furnace that burns either oil or natural gas. Due to the increasing cost of fossil fuels, the operating efficiency of furnaces has become a greater and greater concern.

One method of increasing the fuel efficiency of a burner within a furnace has been to utilize a blower to induce a draft through the furnace to draw the heated air and the products of combustion through a heat exchanger and exhaust them through an exhaust pipe. The blower includes an electric motor and impeller that create a source of negative air pressure such that the heated air and the products of combustion from the burner can travel through as tortured a path as possible to increase the amount of heat removed from the exhaust gases within the heat exchanger. The increase in the flow of air thereby increases the heat transfer and generating capacity of the burner by simultaneously using less fuel per BTU of heat generated.

The addition of a draft inducer to a furnace generates a rating of at least 80% fuel efficiency in a modern furnace. Thus, it is clearly a necessity to introduce a blower to a modern furnace to maintain minimum desired efficiency standards.

Since the introduction of a blower increases the overall cost of a furnace, it is important to manufacture and connect the blower assembly to the furnace in the most effective and efficient manner possible. One common type of blower motor assembly that is currently available is known as a "rectangular exhaust, flush mount blower assembly". In this type of blower assembly, the blower housing is mounted flush to the furnace, which reduces the space requirement for the blower and provides for easier and more accurate mounting of the blower on the furnace. However, this type of blower assembly has the disadvantage of having a rectangular exhaust outlet. Therefore, to allow the customer to attach the blower assembly to a commonly used round exhaust pipe, a rectangular-to-round exhaust adapter must be used. Typically, the exhaust adapter is formed from cast aluminum, which is expensive to manufacture.

An attempt to address the cost of the exhaust adapter is to use an adapter made out of polymeric material. A polymer exhaust adapter is either injection molded or thermal formed. Polymer exhaust adapters have largely been disregarded because of the inherent problems associated with the use of plastics in the harsh operating environment in which the exhaust adapter is placed. Polymers that are able to withstand the harsh operating environment are very expensive, and even with the use of expensive engineering polymers, there still remains potential problems with durability.

The present invention solves the problems associated with currently available furnace blower motor assemblies with a novel and cost efficient solution. There has been an unrecognized but long felt need in the industry to solve the problems stated above. The present invention solves the above stated problems with an easy to manufacture and assemble solution that has eluded manufacturers for many years.

Accordingly, it is an object of the present invention to provide an exhaust adapter that is inexpensive to manufacture yet durable enough to withstand the harsh operating environment associated with a blower assembly. It is another object of the present invention to provide an exhaust adapter that can be easily attached to the blower housing before the blower housing has been mounted onto the furnace. It is yet another object of the invention to provide a simple, cost effective solution to provide a flush mounted blower assembly with an exhaust adapter to mate with a round exhaust pipe.

SUMMARY OF THE INVENTION

The present invention relates to an exhaust adapter formed from a two-piece construction of stamped steel members joined to each other. The exhaust adapter is configured to provide a transition from the rectangular blower outlet of a draft inducer to facilitate connection to a round exhaust pipe. The exhaust adapter includes a circular exhaust outlet that receives an end of the exhaust pipe for easy connection thereto.

The exhaust adapter includes a first section and a second section both formed from stamped metal members. The first and second sections of stamped metal mate with each other along a top seam and a bottom seam. Preferably, the first and second sections of the exhaust adapter can be joined to each other using conventional metal forming techniques, such as a clinch seam or a lap joint.

When the first and second sections of the exhaust adapter are joined to each other, the exhaust adapter defines an attachment flange that can be connected to the rectangular blower outlet of the blower housing. The attachment flange extends around the rectangular blower outlet and provides multiple points of attachment between the exhaust adapter and the blower housing.

The exhaust adapter further includes a transition section extending from the attachment flange to a circular outer rim. The transition section includes angled outer walls that create the transition from the rectangular blower outlet to the circular exhaust outlet.

In a first embodiment of the invention, the first and second sections of the exhaust adapter are joined to each other utilizing a clinch seam formed along both the top seam and the bottom seam of the exhaust adapter. The clinch seam is formed from upstanding flanges formed on both the first section and the second section, where one of the flanges is extended relative to the other flange and is bent over the adjacent flange to form a clinch seam.

In a second embodiment of the exhaust adapter of the present invention, one section of the exhaust adapter includes an upper attachment tab and a lower attachment tab that extend over desired portions of the opposite section of the exhaust adapter. The upper and lower attachment tabs are secured to the opposite section by utilizing either spaced welds or spaced toggle locks. In this manner, the first and second sections can be securely attached to each other after the sections have been formed utilizing conventional metal stamping techniques.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
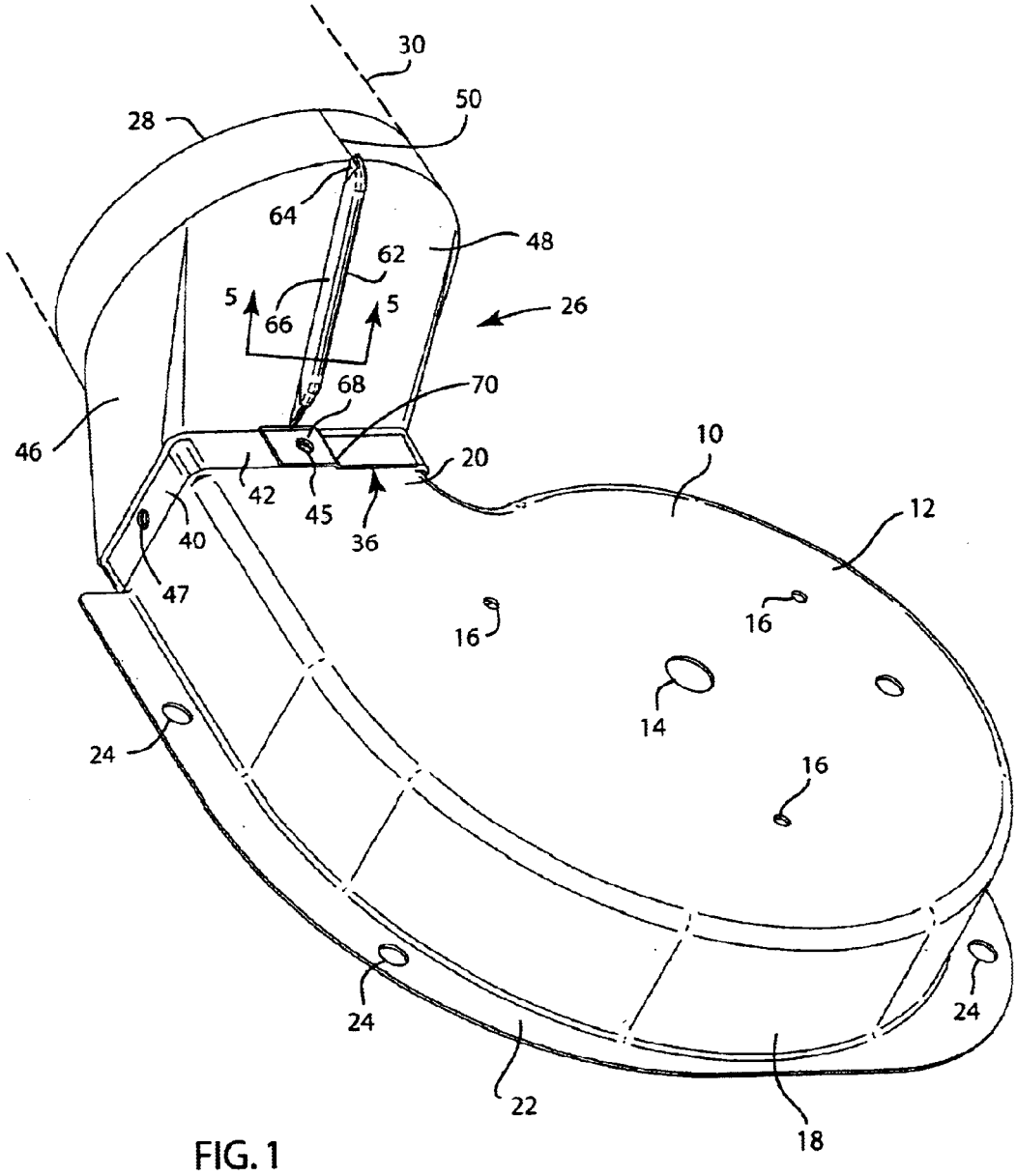
FIG. 1 is a perspective view of a blower housing of a draft inducer including the rectangular blower outlet with the exhaust adapter of the present invention installed thereon.

Referring first to FIG. 1, thereshown is a blower housing 10 that forms part of a blower assembly that is used to expel exhaust gases from a furnace or other similar heating device. The blower housing 10 includes a top mounting surface 12 having a central opening 14 for receiving the shaft of a drive motor (not shown) that is securely mounted to the top surface 12 by the mounting holes 16. The drive motor of the blower assembly is not shown in the drawings for better illustration of the present invention.

The blower housing 10 includes a circular outer sidewall 18 that encloses a rotating impeller mounted to the drive motor shaft. Rotation of the impeller within the blower housing 10 creates a source of negative air pressure within the blower housing 10 to draw exhaust gases from the furnace and direct the exhaust gases out of a blower outlet 20 formed in the blower housing 10. As shown in FIG. 1, the blower outlet 20 has a rectangular cross-section, as is typical with a rectangular exhaust/flush mount blower assembly.

The blower housing 10 includes a mounting flange 22 extending from the sidewall 18. The mounting flange 22 includes a plurality of mounting holes 24 that allow the blower housing 10 to be securely attached to the top of a furnace or similar device. As can be seen in FIG. 1, the configuration of the blower housing 10, including the mounting flange 22, allows the blower housing 10 to be flush mounted with the top of a furnace, which allows the blower housing 10 to be more accurately mounted and positioned.

In the preferred embodiment of the invention, the blower housing 10 is formed from a stamped piece of metal that takes the form illustrated. The stamped metal blower housing shown in FIG. 1 is a conventional design for a blower housing 10 and forms no part of the present invention.

As illustrated in FIG. 1, the blower assembly of the present invention includes an exhaust adapter 26 that is attached to the exhaust outlet 20 of the blower housing 10. The exhaust adapter 26 provides a transition from the rectangular blower outlet 20 to a circular exhaust outlet 28. As shown in broken lines in FIG. 1, the exhaust outlet 28 is configured to mate with a round exhaust pipe 30.

Figure 2:
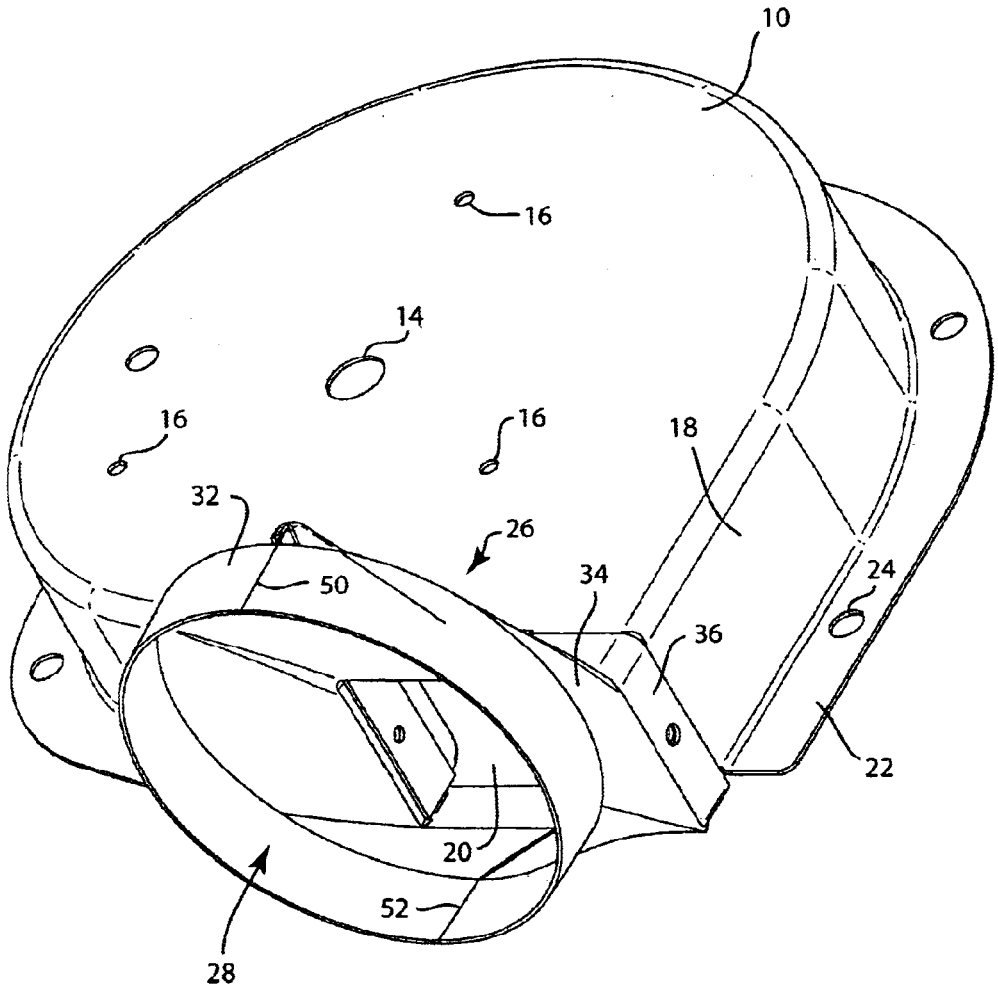
FIG. 2 is a front perspective view of the exhaust adapter mounted on the blower housing of the draft inducer.

Referring now to FIG. 2, the exhaust outlet 28 of the exhaust adapter 26 includes a circular outer rim 32 having an inner diameter approximately equal to the outer diameter of the exhaust pipe received by the exhaust outlet 28. The outer rim 32 is formed as an extension of the transition section 34 which extends upward from an attachment flange 36. The transition section 34 includes outer walls that extend upward and away from the blower housing 10. The transition section 34 creates the transition from the rectangular blower outlet 20 of the blower housing 10 to the circular exhaust outlet 28.

Figure 3:
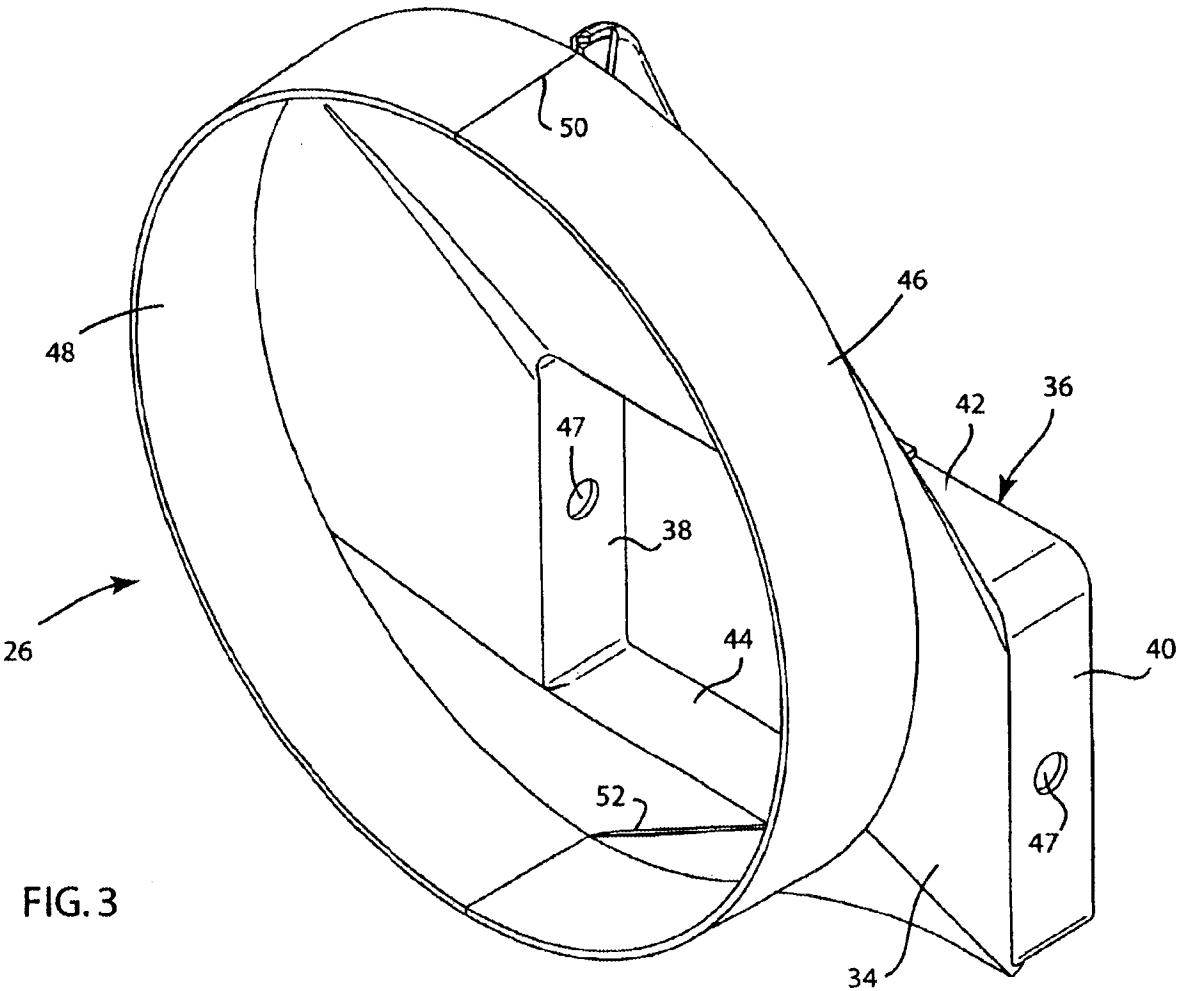
FIG. 3 is a front perspective view of a first embodiment of the exhaust adapter.

Referring now to FIG. 3, the attachment flange 36 of the exhaust adapter 26 includes a pair of spaced side flanges 38 and 40, a top flange 42 and a bottom flange 44. As can best be seen in FIGS. 1 and 3, the top flange 42 includes an attachment opening 45 and the side flanges 38 and 40 also include similar attachment openings 47. The attachment openings 45 and 47 align with similar attachment openings formed in the blower housing 10 near the blower outlet 20 to allow the exhaust adapter 26 to be easily attached to the blower housing 10.

As best illustrated in FIGS. 1 and 3, the exhaust adapter 26 is formed from a first, right section 46 and a second, left section 48 joined to each other along a top seam 50 and a bottom seam 52. Preferably, both the first section 46 and the second section 48 are formed from stamped sections of metal. The formation of the first section 46 and the second section 48 from stamped metal greatly reduces the cost of forming the exhaust adapter 26, as compared to prior art exhaust adapters that are formed from either die cast aluminum or expensive polymer materials. The use of stamped metal greatly reduces the material cost of the exhaust adapter and reduces the assembly time and cost as well.

Figure 4:
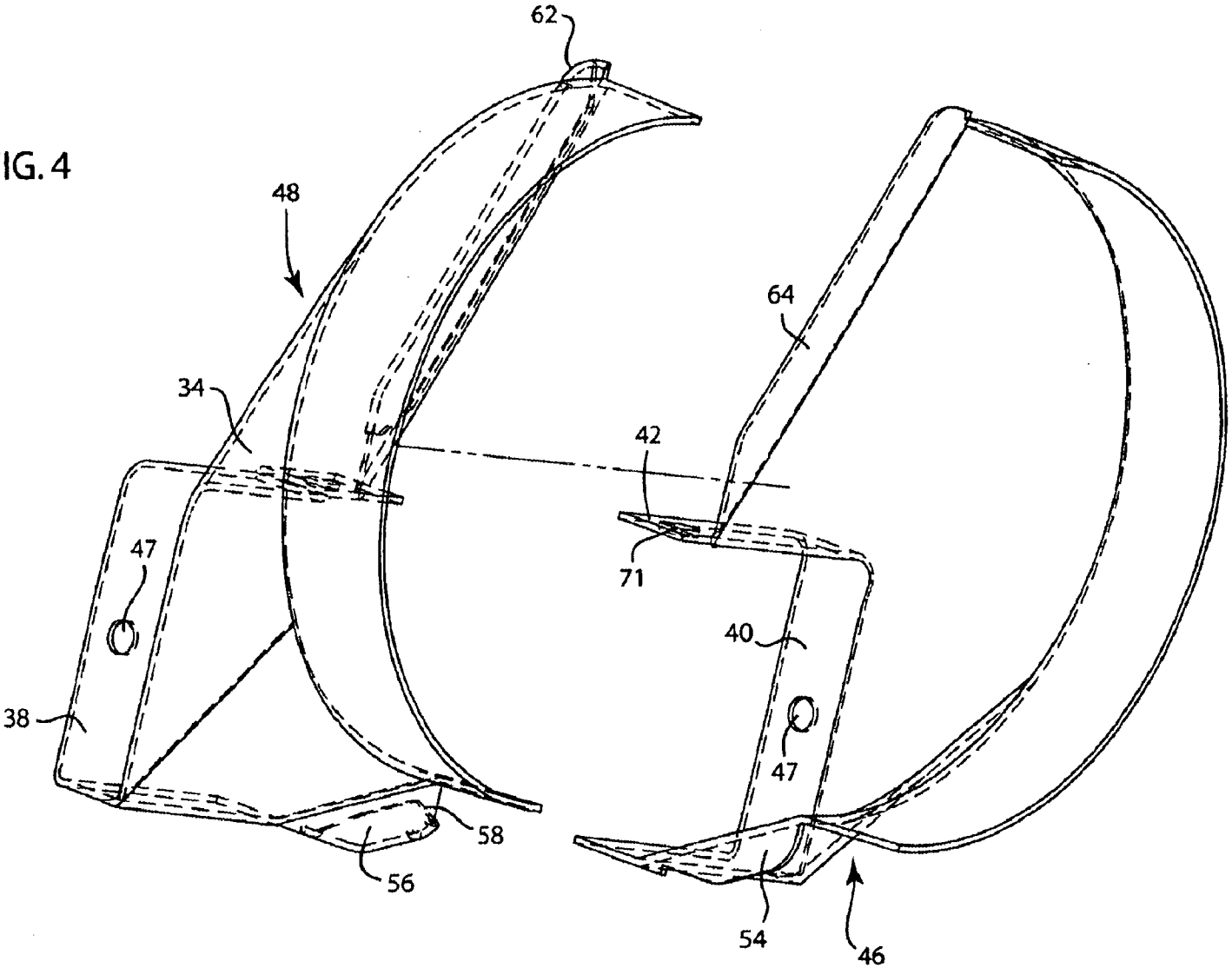
FIG. 4 is an exploded perspective view of the first embodiment of the exhaust adapter showing the connections between the stamped metal sections.
Figure 6:
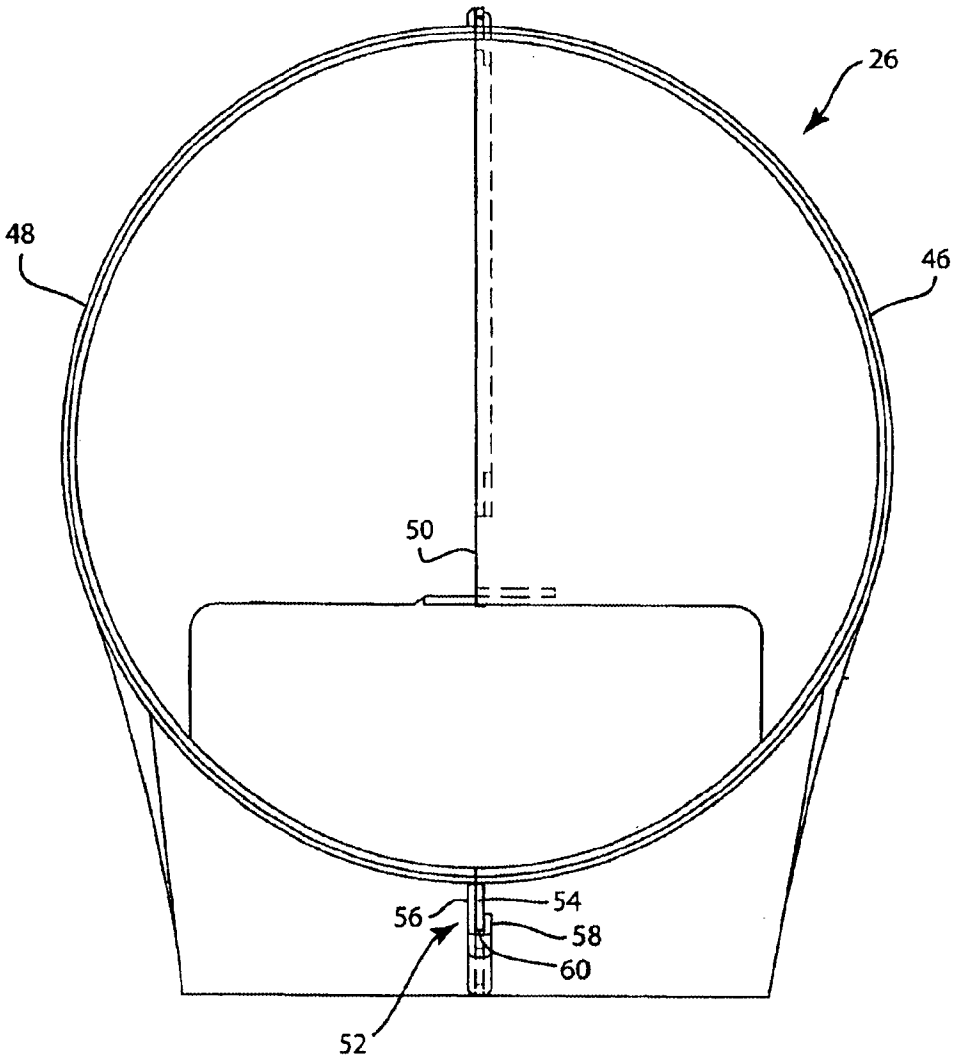
FIG. 6 is a front view of the exhaust adapter of the first embodiment of the invention.

As can best be seen in FIGS. 4 and 6, the first section 46 includes an upstanding lower flange 54 formed along its bottom edge. The lower flange 54 is positioned adjacent to a similar lower flange 56 formed on the second section 48. The lower flange 56 formed on the second section 48 includes an extended section 58 that is bent over the outer edge 60 of the lower flange 54 to create a clinch seam between the first and second sections 46 and 48. During the construction process of the exhaust adapter 26, the bottom clinch seam 52 is formed using conventional metal working techniques.

Figure 5:
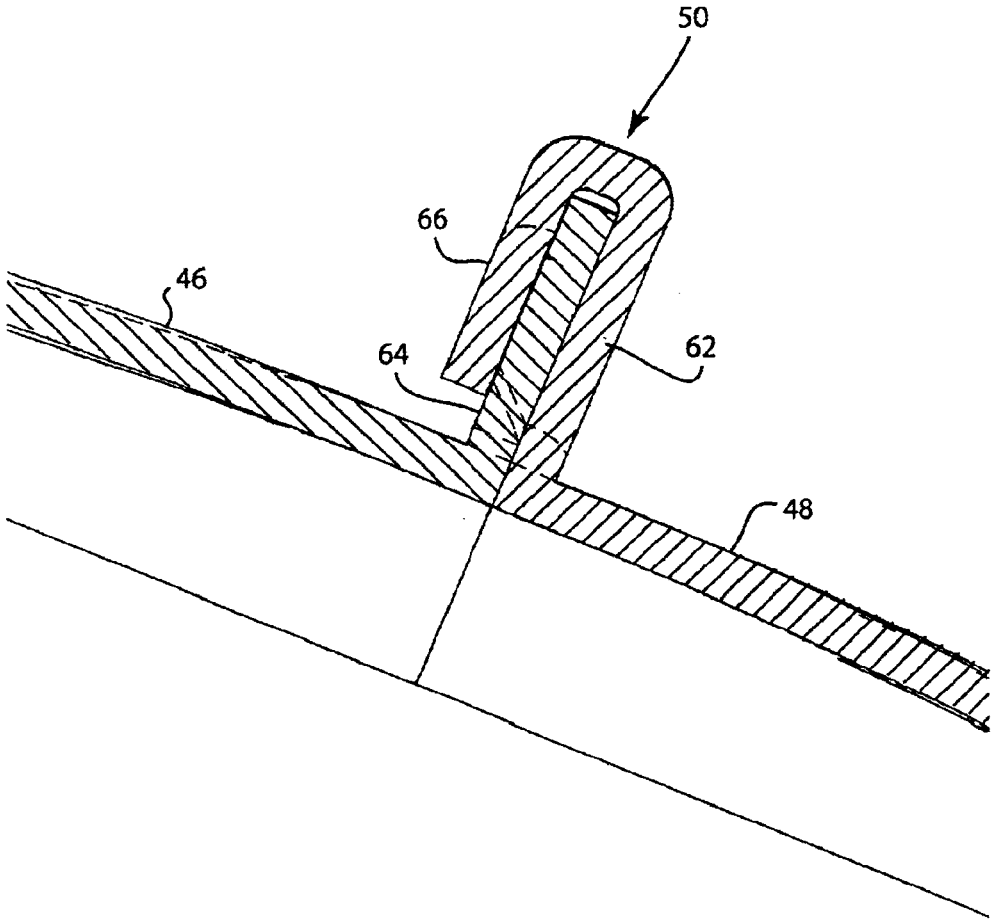
FIG. 5 is a section view taken along line 5—5 of FIG. 1 showing the joint created between the two sections of the exhaust adapter.

Referring now to FIG. 5, the first section 46 of the exhaust adapter 26 includes an upstanding upper flange 62 that extends along the top seam of the exhaust adapter 26 from the attachment flange 36 to the outer rim 32. As can be seen in FIG. 1, the opposite, first section 46 also includes an upper flange 64 that abuts against the upper flange 62 formed on the second section 48. The upper flange 62 includes an extended portion 66 that is folded over the flange 64 to create the clinch seam. Referring to FIG. 5, the extended section 66 creates secure joint between the first section 46 and the second section 48 along the top seam 50. As was discussed previously, the clinch seam is formed using conventional metal working practices and creates a secure joint between the two sections of the exhaust adapter 26.

Referring back to FIG. 1, the second section 48 includes an overlap section 68 formed on the attachment flange 36. The overlap section 68 is set off by an upward bend 70 such that the opening 46 formed in the overlap section 68 aligns with a corresponding opening 71 formed in the attachment flange 36 of the first section 46, as shown in FIG. 4. In this manner, both the first section 46 and the second section 48 can be securely attached to the blower housing 10.

Figure 7:
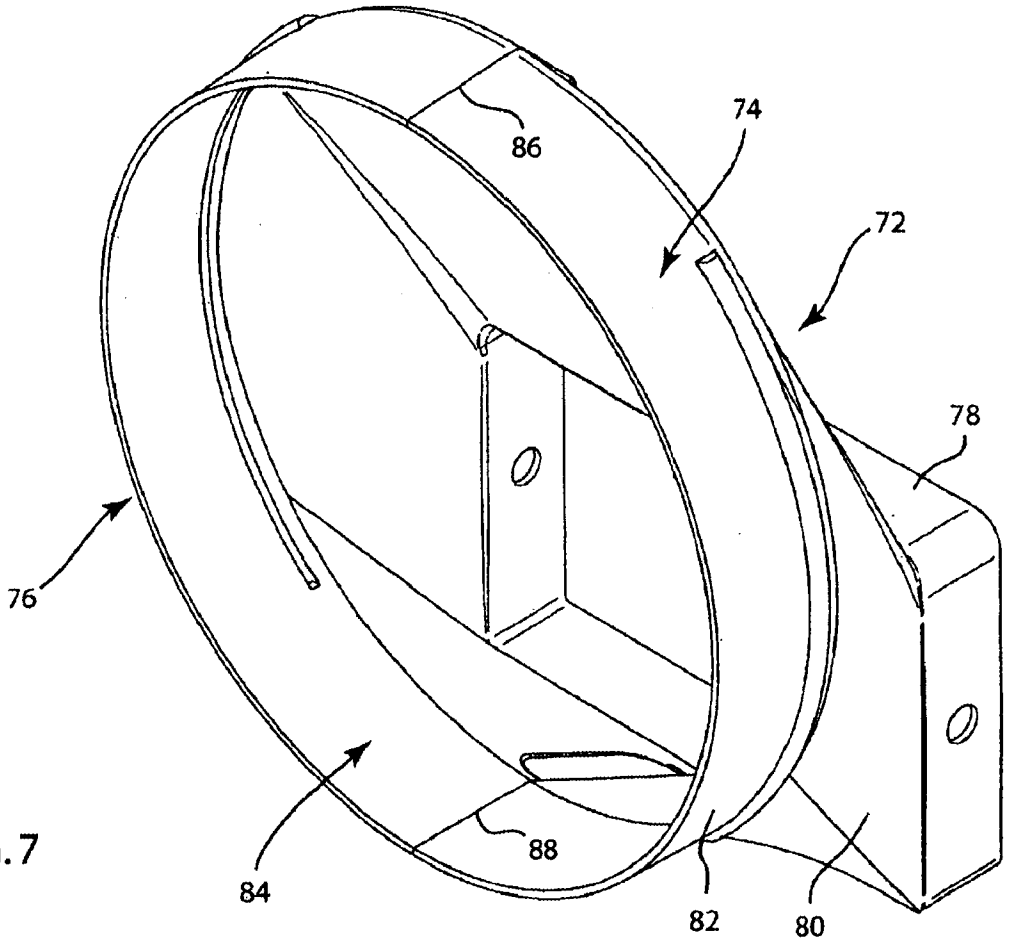
FIG. 7 is a front perspective view illustrating the exhaust adapter of a second embodiment of the invention.

Referring now to FIG. 7, thereshown is a second embodiment of the exhaust adapter 72 of the present invention. The second embodiment of the exhaust adapter 72 includes a first, right section 74 and a second, left section 76 that are joined to each other to define the entire exhaust adapter 72. When the first section 74 and the second section 76 are attached to each other, the combination creates an attachment flange 78, a transition section 80 and a circular outer rim 82 that defines the circular exhaust outlet 84. The different sections of the exhaust adapter 72 of the second embodiment of the invention shown in FIG. 7 are identical to those shown in the first embodiment of the exhaust adapter 26 shown in FIG. 3. However, the difference between the first embodiment of FIG. 3 and the second embodiment of FIG. 7 is the method by which the first and second sections of the exhaust adapter are attached to each other to form the exhaust adapter.

As can be seen in FIG. 7, the exhaust adapter 72 includes a top seam 86 and a bottom seam 88. The first section 74 and the second section 76 are joined to each other along the top and bottom seams 86 and 88.

Figure 8:
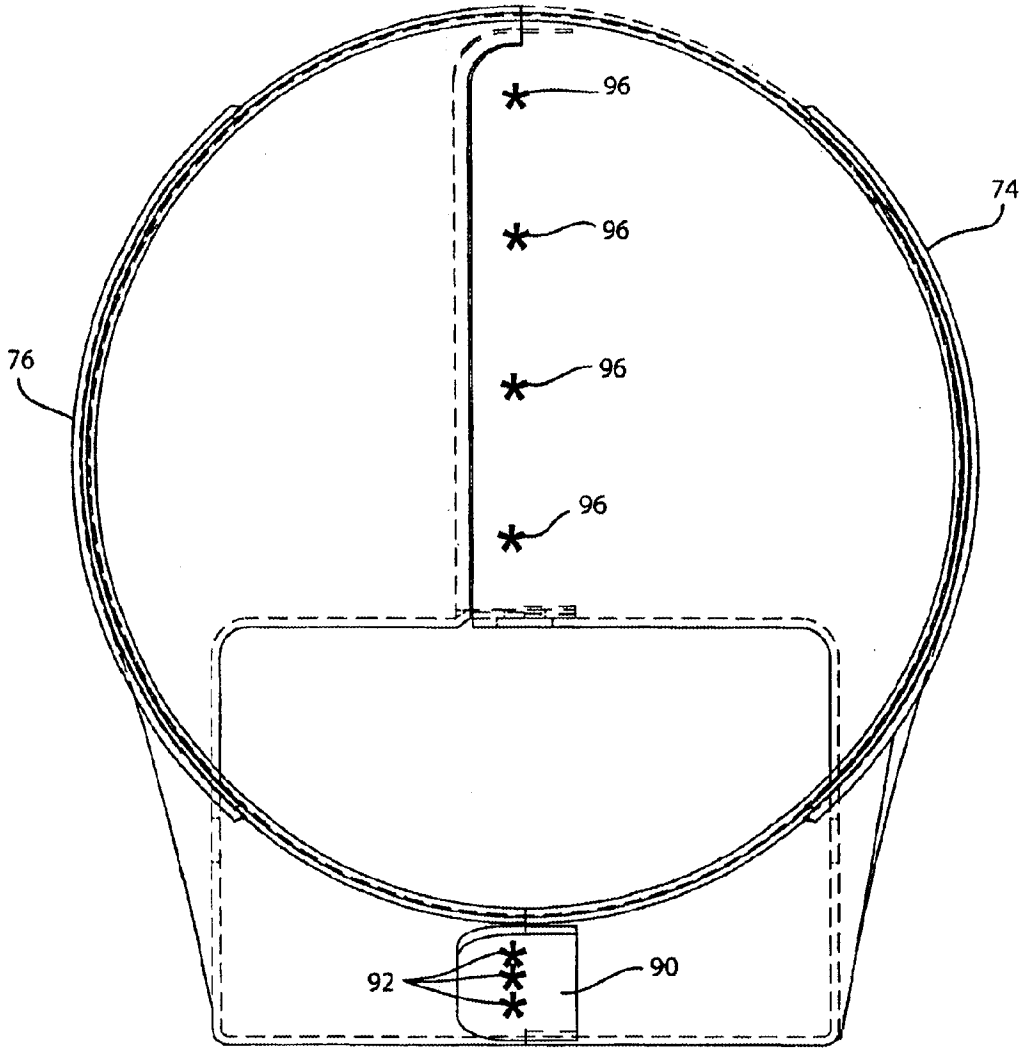
FIG. 8 is a front view of the exhaust adapter of the second embodiment of the invention.
Figure 9:
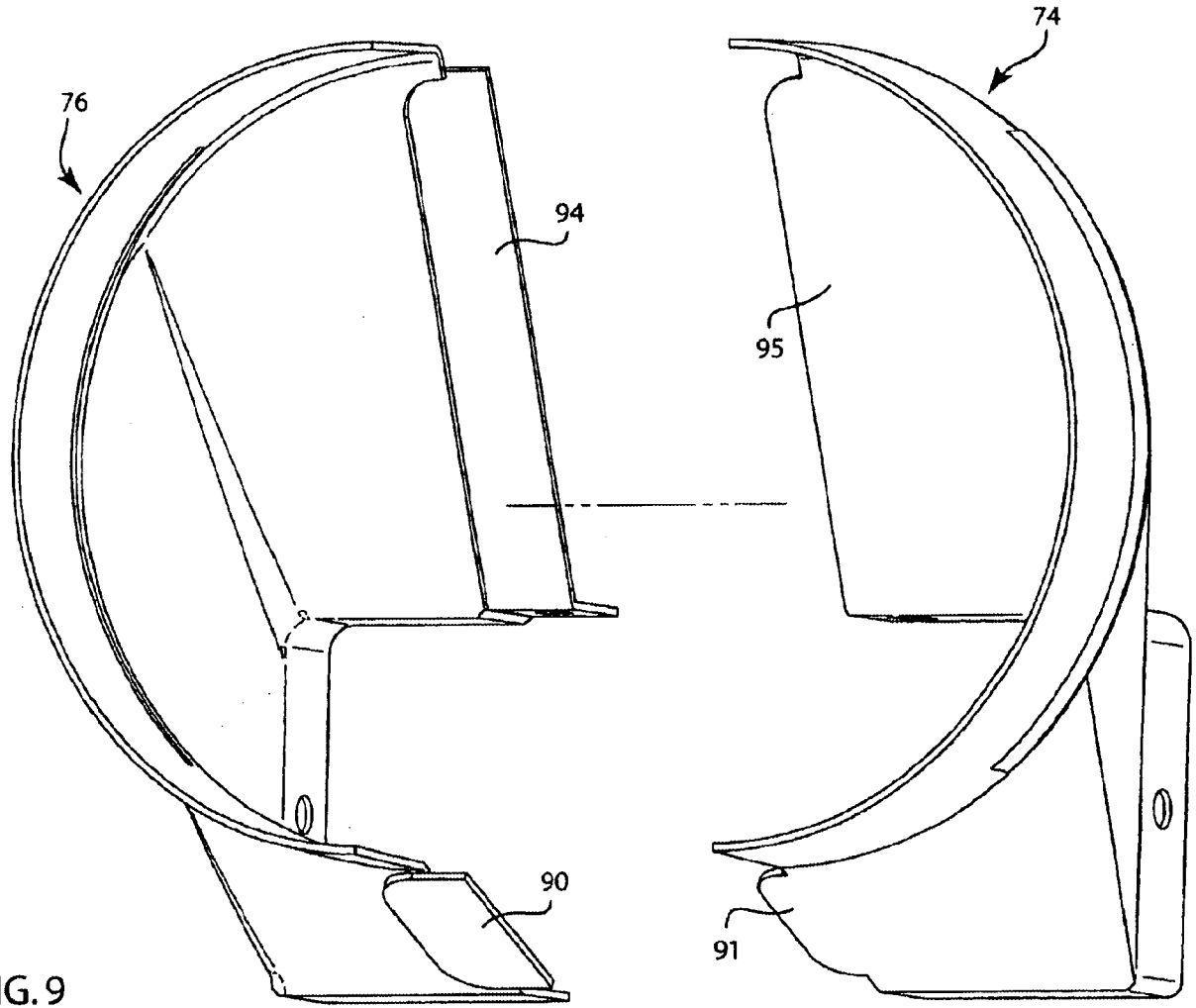
FIG. 9 is an exploded perspective view of the exhaust adapter of the second embodiment.

Referring now to FIGS. 8 and 9, the second section 76 includes a lower attachment tab 90 that extends over a mating protrusion 91 formed as a portion of the lower transition section of the first section 74. As illustrated in FIG. 9, the attachment tab 90 extends past the bottom seam 88 and overlaps the lower protrusion 91 formed on the first section 74. Referring back to FIG. 8, the protrusion 91 of the first section 74 is secured to the attachment tab of the second section 76 at a series of discrete locations 92 such that the two sections 74 and 76 are joined by the attachment tab 90. In the preferred embodiment of the invention, the attachment locations 92 can be formed by a toggle lock or spot weld.

Referring back to FIG. 9, the second section 76 includes an upper attachment tab 94 that overlaps an upper protrusion 95 formed as part of the first section 74. The upper attachment tab 94 is secured to the upper protrusion 95 formed on the first section 74 at a series of discrete locations 96, as illustrated in FIG. 8. Once again, the attachment locations 96 can be formed by a toggle lock or spot weld, or similar equivalent method of metal attachment.

As described in the above disclosure, the first and second embodiments of the exhaust adapter of the present invention are each formed from two separate, stamped sections of metal joined to each other along both a top seam and a bottom seam. The creation of the exhaust adapter from two sections of stamped metal is a dramatic improvement over the prior art. The use of stamped metal dramatically reduces the cost of production of the exhaust adapter compared to prior art cast aluminum exhaust adapters. The use of the two sections of stamped metal allow the exhaust adapter to be manufactured using relatively low cost materials while utilizing an inexpensive and rapid metal working techniques.

Although the present invention describes two methods of joining the two sections of the exhaust adapter to each other, it is contemplated by the inventor that other methods of joining two separate metal component could be utilized while operating within the scope of the present invention. Additionally, ultimate configurations for the shape and size of the exhaust adapter are also contemplated as being within the scope of the present invention.

Various alternatives and embodiments are contemplated as being within the scope of the following claims particularly pointing out and distinctly claiming the subject matter regarded as the invention.

I claim:

1. An exhaust adapter for use with a draft inducer operable to expel exhaust gases from a furnace through a circular exhaust pipe, the draft inducer having a blower housing including a rectangular blower outlet, the exhaust adapter comprising:

a first section formed from stamped metal defining a first half of an attachment flange, a first half of a circular exhaust outlet, and a first half of a transition section extending between the attachment flange and the circular exhaust outlet;

a second section formed from stamped metal and configured to mate with the first section, the second section defining a second half of the attachment flange, a second half of the circular exhaust outlet and second half of a transition section extending between the attachment flange and the circular exhaust outlet;

wherein the first section and the second section are formed separate from the blower housing and are attachable to each other along a first seam and a second seam to define the exhaust adapter, the attachment flange of the exhaust adapter being removably attachable to the rectangular blower outlet of the blower housing.

2. The exhaust adapter of claim 1 wherein the attachment flange is rectangular and configured to closely mate with the rectangular blower outlet.

3. The exhaust adapter of claim 1 wherein the first section and the second section are formed from stamped sheet metal.

4. The exhaust adapter of claim 1 wherein the first section and the second section are attachable to each other along the transition section.

* * * * *